US006640376B2

(12) United States Patent
Kaleta

(10) Patent No.: US 6,640,376 B2
(45) Date of Patent: Nov. 4, 2003

(54) SELF-WRINGING STRING MOP

(76) Inventor: Bryan Kaleta, 1037 Hinswood Dr., Darien, IL (US) 60561

( * ) Notice: Subject to any disclaimer, the term of this patent is extended or adjusted under 35 U.S.C. 154(b) by 250 days.

(21) Appl. No.: 09/925,809

(22) Filed: Aug. 10, 2001

(65) Prior Publication Data

US 2003/0028986 A1 Feb. 13, 2003

(51) Int. Cl.[7] ..... A47L 13/12; A47L 13/14; A47L 13/20; A47L 13/50; A47L 13/58

(52) U.S. Cl. ..... 15/119.1; 15/116.1

(58) Field of Search ..... 15/116.1, 116.2, 15/119.1, 119.2, 260

(56) References Cited

U.S. PATENT DOCUMENTS

| | | | | |
|---|---|---|---|---|
| 1,352,837 | A | | 9/1920 | Sanguinet |
| 1,994,769 | A | | 3/1935 | Jenkins |
| 2,222,834 | A | | 11/1940 | Cooper |
| 2,618,001 | A | | 11/1952 | Waldrup |
| 2,820,232 | A | | 1/1958 | Vosbikian et al. |
| 3,497,901 | A | | 3/1970 | Shipp |
| 4,809,387 | A | | 3/1989 | Nakamura et al. |
| 5,894,625 | A | * | 4/1999 | Vosbikian ..... 15/119.1 |

* cited by examiner

*Primary Examiner*—Robert J. Warden, Sr.
*Assistant Examiner*—Laura C Cole
(74) *Attorney, Agent, or Firm*—Alan B. Samlan

(57) ABSTRACT

A hand held cleaning device that has a self wringing mechanism for extracting liquids from a flexible cleaning element. A wringer mechanism is mounted at the end of an elongated handle. A slidable mop head base is mounted on the bottom of the handle and slides along the elongated handle. When the mop head is moved from its first cleaning position, the flexible cleaning element is drawn through the wringing assembly to remove absorbed liquids from the cleaning element. A pivotal gate opens, allowing the mop head and cleaning element to pass back through the wringing mechanism to assume its original cleaning position. In an alternate embodiment the mop head is attached to the elongated handle and the wringer mechanism is mounted for slidable movement with respect to the elongated handle.

36 Claims, 4 Drawing Sheets

13
12
10
18
20
76
82
84
40
68
14
46
72
16
24
66
36
64
26
48
38
34
32
30
28
38

SELF-WRINGING STRING MOP

BACKGROUND AND SUMMARY OF THE INVENTION

This invention relates to floor cleaning devices and more particularly, to a hand held mop utilizing a wringing mechanism on the mop head to remove water or other moisture from the mop strands.

Numerous floor-cleaning devices have been utilized over the years. Generally they all provide a labor saving device in that they allow the user to stand upright while placing the cleaning element in contact with the floor surface. Broadly classified, there are string mops, sponge mops and brooms. The string mop uses a plurality of cotton or synthetic strings, or non-woven strips attached to a mop head for absorbing fluids and for cleaning the floor surface. Alternatively the plurality of strings may be replaced with a single, soft cloth although the operation of the two embodiments is the same. A squeezing mechanism removes water or other absorbed liquids from the strings. The squeezing mechanism can be a separately located squeezing mechanism usually placed over a liquid catching container such as a bucket. Alternatively, such as disclosed herein, the squeezing mechanism can be mounted on the mop, near the mop head.

A problem of the prior art devices is that some do not completely wring out the mop strings all the way to the string tips. This leaves unwanted liquid in the strings which reduces the amount of moisture that the strings can absorb in the repetitive mopping cycle. Another problem is that the prior art devices do not provide a wringing mechanism that provides an easily adjustable means to adjust the clamping pressure that the wringing rollers apply against the mop strings. Another problem not adequately solved is repositioning the mop strings below the wringing mechanism after the mop string are wrung out. After the strings are wrung out, they are generally above the wringing mechanism. In the instances where the prior art dealt with the problem of repositioning the mop strings below the wringing mechanism after they are wrung out, the mechanisms employed were totally inadequate.

For example, one type of wringer mop is illustrated in U.S. Pat. No. 1,352,837 issued to Sanguinet on Sep. 14, 1920 entitled "Wringer Mop". This patent teaches the use of a pair of squeezing rollers mechanically connected by tension springs to draw the rollers toward each other as the strings are compressed between them. The tips of the strings are not suppose to be drawn past the rollers during squeezing. The inventor recognized the problem of pushing the strings back past the squeezing rollers if the strings are drawn past the squeezing rollers by providing a web that directs the movement of the strings back through the squeezing rollers.

U.S. Pat. No. 1,994,769 issued to Jenkins on Mar. 19, 1935 and is entitled "Mop". This patent disclosed a pair of wringing rollers through which the strings were drawn for moisture extraction. The inventor again recognized the problem of getting the strings back past the wringing rollers after moisture is extracted. Jenkins addressed the problem by providing an arm and pivot mechanism that separated the wringing rollers a sufficient distance allowing the strings to pass back between the rollers.

U.S. Pat. No. 2,618,001 issued to Waldrup on Nov. 18, 1952 and is entitled "Self-Wringing Mop". This patent addressed the problem of pushing the mop cloth back through the squeezing rollers after it is wrung by not allowing the cloth to be drawn up past the rollers when it is wrung out. Obviously this is not a good solution to the problem because the cloth is not completely wrung out thus leaving excessive moisture in the cloth.

U.S. Pat. No. 2,820,232 issued to Vosbikian et al. on Jan. 21, 1058 and is entitled "Strand Type Mop With Extracting Head". The inventor recognized the problem of completely wringing the strings and the difficulty of getting the strings back below the squeezing rollers to repeat the mopping cycle. In this patent the squeezing rollers squeeze the strings all the way to the tips of the strings. To reposition the mop strings below the squeezing rollers, one set of squeezing rollers is pivoted and moved around the strings. A tapered member separates a pair of spring loaded cones mounted between the two lower squeezing rollers. This pushes the cones away from each other creating a gap through which the tapered member passes. The mop strings are repositioned to the original mopping position. The problem with this mechanism is that the cones and the spring loaded sliding mechanism are prone to failure due to contaminants entering the sliding mechanism and the eventual rusting of the spring mechanism. Furthermore the lower rollers must be very strong and securely mounted to the frame to keep them from bending when the string are pulled back through the squeezing rollers.

None of the prior art devices adequately solve the problem of removing moisture from the string of a self-wringing string mop and then repositioning the roller mechanism with respect to the strings so that the wringing cycle can be repeated with constant results. In order to remove the maximum amount of moisture captured in the mop strings, it is necessary to wring out the strings all the way to the string tips. Then the mop strings must be repositioned in front or forward of the wringing mechanism so that the strings can contact the surface to be mopped. Applicant's invention solves the problem of repositioning the mop strings ahead of the roller mechanism after the mop strings are wrung out.

OBJECTS AND ADVANTAGES

It is an object of the present invention to provide an improved hand held cleaning device having a frame that supports a squeezing mechanism and having a moveable head that retains a singular or plurality of flexible absorbent cleaning elements such as strings.

Another object is to provide a cleaning device that has a self-wringing mechanism that draws the absorbent cleaning element or elements through a compressible wringing mechanism to remove moisture contained in the absorbent cleaning elements.

Yet another object is to provide a cleaning device that has a wringing mechanism that draws the cleaning elements completely through the wringing mechanism and provides for the repositioning of the cleaning elements with respect to the wringing mechanism after the cleaning elements are wrung. A related object is to provide a wringing mechanism that has a pivotal moisture extraction member that pivots to allow the cleaning elements to be repositioned with respect to the wringing mechanism after the elements are wrung so that the elements are in position to repeat the mopping cycle.

It is still another object to provide a cleaning device that easily allows the extraction of fluids from the absorbent cleaning elements without the user's hands contacting the cleaning elements.

SUMMARY OF THE INVENTION

The present invention is a hand held cleaning device for cleaning floors and other flat surfaces. The user grasps an elongated handle at a top end. At the other end of the elongated handle is a wringer mechanism. The wringer mechanism has an extractor roller and a compression bar in spaced parallel relationship to the extractor roller forming a gap therebetween. The compression bar is mounted on a pivotal gate. A mop head having a flexible absorbent cleaning element is attached to a slidable mop head base. The mop head with the absorbent cleaning element is used in the mopping operation to absorb liquids. The mop head is drawn upward by the user from its initial cleaning position into the gap between the extractor roller and the compression bar. Absorbed liquids are squeezed from the absorbent cleaning element. The user continues to draw the mop head past the extractor roller until the entire cleaning element is wrung. To reposition the absorbent cleaning element below the wringer mechanism, the user grasps a handle attached to the mop head and pushes the mop head down in the direction of the wringer mechanism. The compression bar pivots away from the cleaning element allowing the cleaning element to move past the extractor roller and back to its original cleaning position. The pivotal gate is spring loaded so that once the cleaning element passes the compression bar, the pivotal gate and the compression bar return to their original positions.

BRIEF DESCRIPTION OF THE DRAWINGS

The present invention will be more clearly understood from the following Brief Description of the Drawings in which:

FIG. 11 is a side elevation view of the elongated handle with the mop head mounted at the bottom portion of the handle.

FIG. 12 is a side elevation view of the slidable wringer handle and wringer mechanism.

FIG. 13 is side elevation view of the slidable wringer handle and wringer mechanism mounted on the elongated handle.

DESCRIPTION OF THE PREFERRED EMBODIMENT

Figure 1:
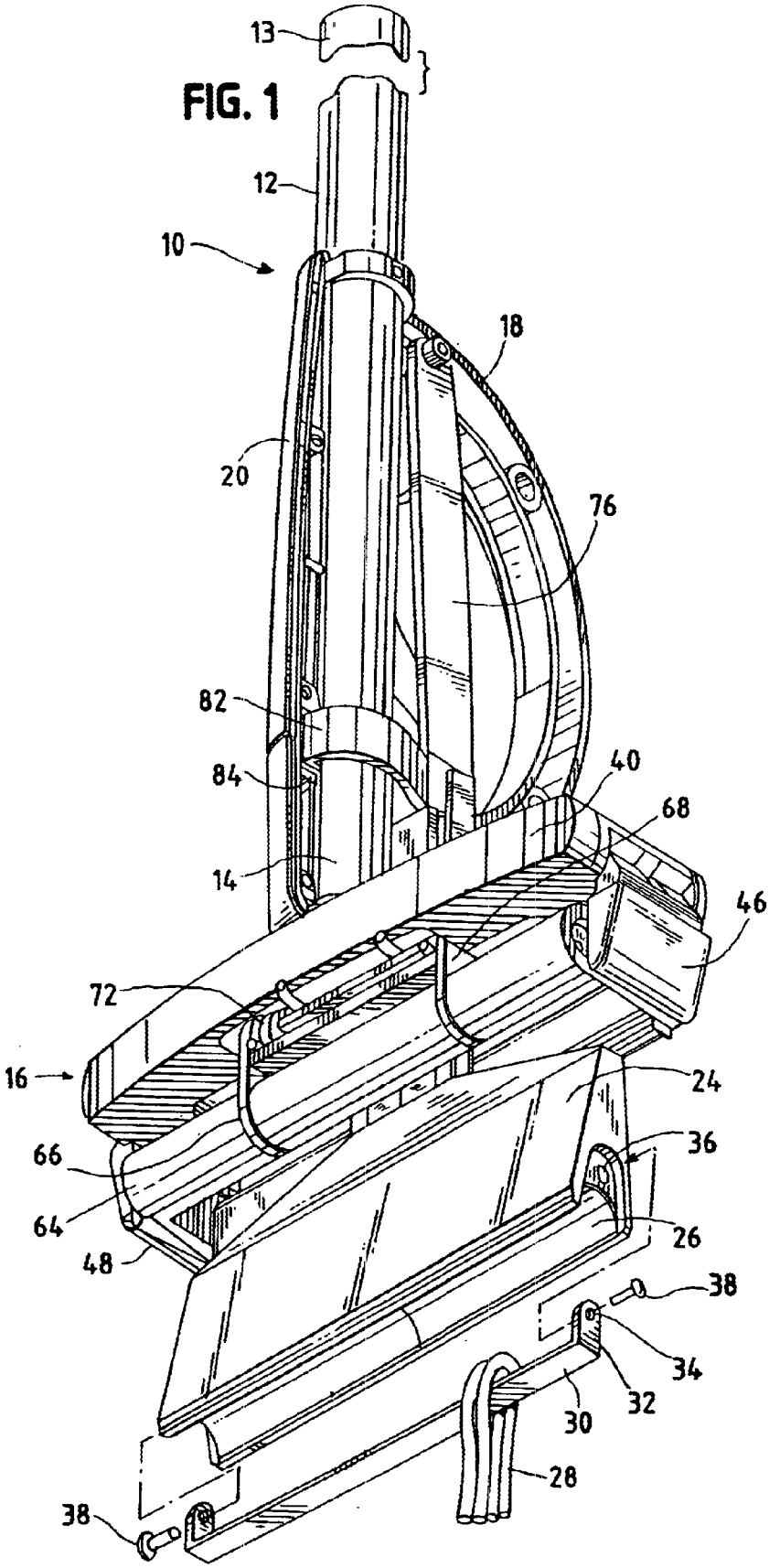
FIG. 1 is a perspective view, partially broken away, of the inventive self-wringing mop showing the mop head that holds the plurality of absorbent cleaning elements or strings and the wringing assembly.
Figure 2:
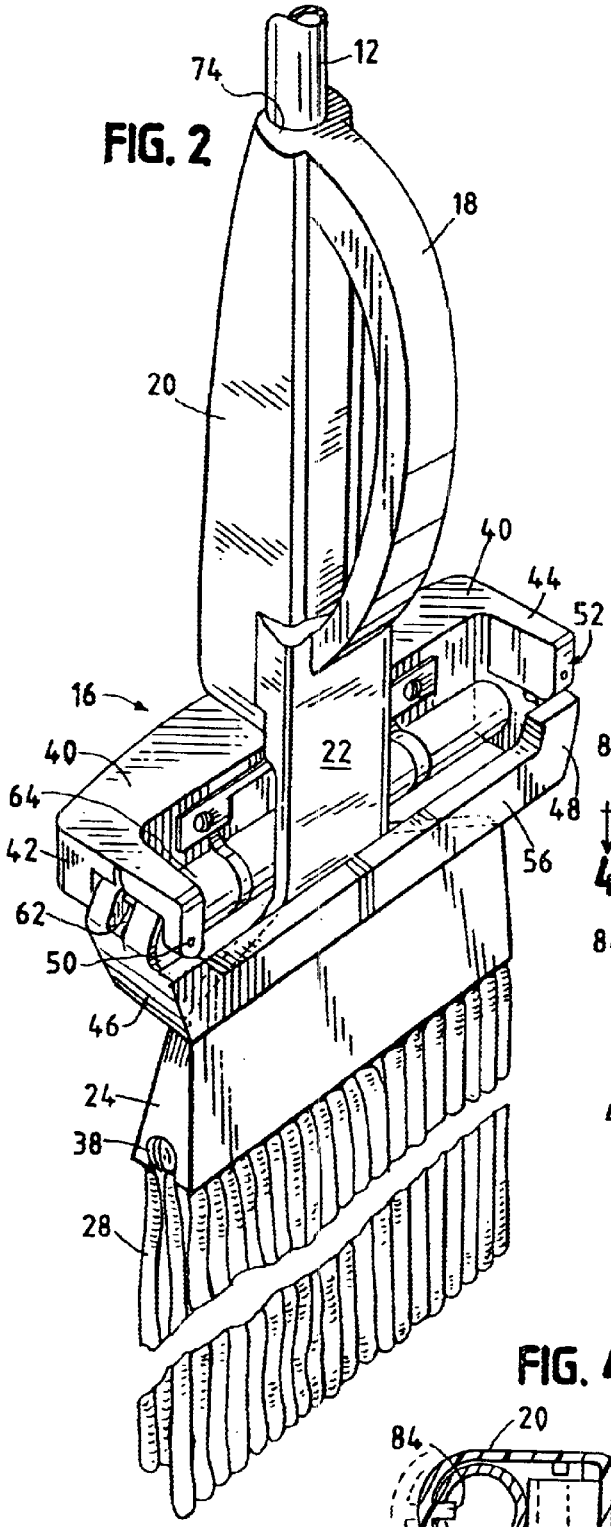
FIG. 2 is a perspective view, partially broken away, of the bottom end of the elongated handle illustrating the mop head with the absorbent cleaning elements and the wringing assembly.

Turning to FIGS. 1 and 2, there is illustrated a mop 10 of the present invention. There is an elongated handle 12 having opposite ends being a top portion 13 and a bottom portion 14. Mounted to the bottom portion 14 is a wringer mechanism 16. A slidable mop head handle 18 is also mounted to the bottom portion 14. The mop head handle 18 has a mop head base 20 that encompasses the bottom portion 14. A neck 22 extends from the mop head handle 18 and mop head base 10 to connect to a mop head 24. The mop head 24 terminates in an open end 26 that has provisions to receive a flexible cleaning element 28. The flexible cleaning element 28 can be any of numerous types such as cotton or synthetic strings, non-woven absorbent material, natural or synthetic strips or a singular sheet of material. Any flexible absorbent material can be adapted to be used in the mop head 24 to absorb moisture. Throughout the application, the term "cleaning element" is meant to encompass all such various embodiments.

The cleaning element 28 is attached to the open end 26 by being wrapped around a unshaped retaining bar 30 that has upstanding arms 32 at opposite ends. The arms 32 have fastener receiving holes 34. These align with holes 36 at the open end 26 of the mop head 24. Fasteners 38 pass through the holes 36 and 34 to securely hold the retaining bar 30 into the open end 26. In this manner the cleaning element 28 can be replaced when worn or if another type of material is desired. Other types of permanent and removable fastening mechanisms will be apparent to those skilled in the art, and the invention is not to be limited by the type of fastening mechanism used.

The mop 10 is used to wipe and absorb moisture from a surface such as a floor. The mop 10 is in its initial cleaning position as seen in FIG. 2, with the cleaning element 28 positioned below the wringing mechanism 16. In this position, the wringing mechanism 16 does not interfere with the mopping operation and does not strike the floor. However, when the cleaning element 28 is wrung out to remove moisture from it, the cleaning element 28 is raised above the wringing mechanism 16. Applicant's unique wringing mechanism 16 provides for the movement and repositioning of the mop head 24 and its cleaning element 28 to its initial cleaning position.

As seen in FIGS. 1 and 2, the mop wringing mechanism 16 has a u-shaped stationary frame 40 mounted to the bottom portion 14. The u-shaped frame 40 has a length that extends substantially perpendicular to the longitudinal axis of the elongated handle 12. A pair of arms 42, 44 are disposed at either end of the u-shaped stationary frame 40 and extend in the direction of the neck 22. A pair of pivotal gates or hinges 46, 48 are attached to the arms 42, 44 respectively by means of pivot pins 50, 52. The pivot pins 50, 52 have an axis substantially perpendicular to the longitudinal axis of the elongated handle 12. Extending from the pivotal gates 46, 48 are compression bars 54, 56 respectively. The compression bars 54, 56 extend toward each other so that their end tips 58, 60 are adjacent to each other when the mop 10 is in its initial cleaning position. A spring 62 is mounted between the arms 42, 44 and the pivotal gates 46, 48 to apply a force to the pivotal gates 46, 48 to maintain the gates 46, 48 in a closed position while mopping such as illustrated in FIGS. 1 and 2. The compression bars 54, 56 can be smooth bars, rollers or any similar structure that will apply a compressive force to the cleaning element 28 when moisture is to be wrung from it as will be described later herein.

Mounted to the underside of the u-shaped stationary frame 40 is a segmented extractor roller 64. Although the segmented extractor roller 64 is shown comprised of several rollers, one roller will also work. Also, the roller 64 can be a smooth bar or non-rotating structural member, that allows the cleaning element 28 to slide between the roller 64 and the compression bars 54, 56. The roller 64 and compression bars 54, 56 are mounted to the u-shaped stationary frame 40 so that they are parallel to each other in the normal cleaning position. The segmented extractor roller 64 is connected to the frame 40 by means of a pair of links 66, 68. One end of the links 66, 68 is pivotally connected by pivot pin 70 to the u-shaped frame 40. The other end of the links are connected to the extractor roller 64. A spring 72 applies a force to the links 66, 68 forcing the extractor roller 64 against the neck 22. The force of the spring 72 can be adjusted by means of any conventional adjustment mechanism that varies the spring force.

Figure 3:
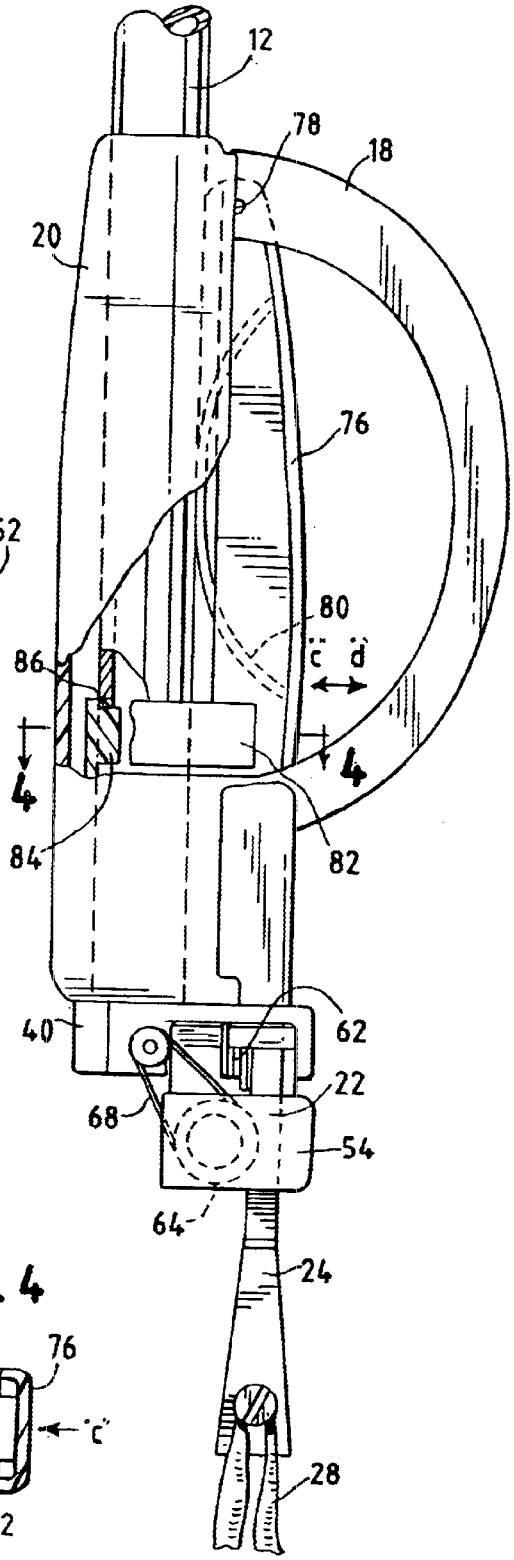
FIG. 3 is a side elevation view, partially broken away, of the device of FIG. 2 illustrating the mop head base actuating mechanism and its operation with respect to the wringing mechanism.
Figure 4:
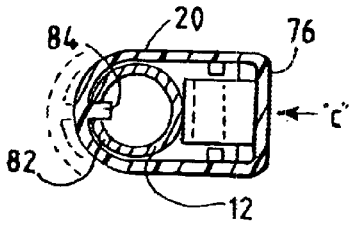
FIG. 4 is a cross sectional view taken along line 4—4 of FIG. 3 illustrating the actuator arm with respect to the elongated handle.

As seen in FIG. 3, the mop head base 20 has a longitudinal channel 74 extending substantially along its entire length. The channel 74 receives the elongated handle 12 so that the mop head base 20 can slide along the handle 12. The length of travel of the mop head base 20 along the handle is controlled by several elements. The mop head base 20 is limited in its downward travel toward the floor by the u-shaped stationary frame mounted at the bottom of the elongated handle 12. The mop head base 20 further has locking means that retain the mop head base 20 in a locked position until the user desires to move As seen in FIGS. 3 and 4, a trigger member 76 has a pin 78 at one end connecting it to the handle 18 and the mop head base 20. A spring 80 pushes the trigger member 76 away from the elongated handle 12. At the other end of the trigger member 76 is an actuator arm 82 that extends around the elongated handle 12 to the side opposite the trigger member 76. There is a locking pin 84 on the actuator arm. A slot 86 in the elongated handle 12 receives in locking relationship the locking pin 84. In order to release the mop head base 20 from the elongated handle, the user grasps the trigger member 76 and squeezes it. This overcomes the force of the spring 80 causing the actuator arm 82 to release the locking pin 84 from the slot 86.

Figure 5:
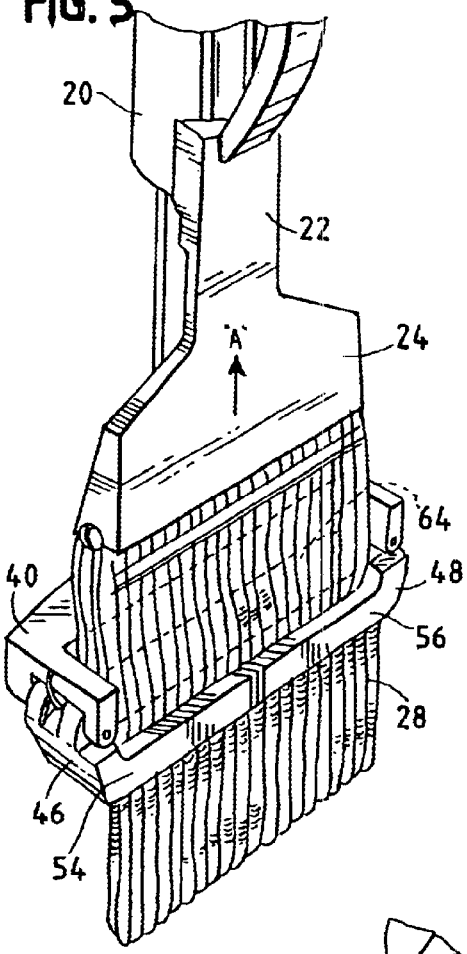
FIG. 5 is a perspective view, partially broken away, showing the absorbent cleaning elements being drawn through the wringing mechanism.

To use the mop 10, the user grasps the top and middle of the elongated handle 12 with their hands and holds the mop at a comfortable angle to the floor or surface to be cleaned. The mop 10 is oriented so that the u-shaped stationary frame 40 is facing up and the compression bars 54, 56 are oriented at the underside of the mop 10, toward the floor. The cleaning element 28 absorbs water or other liquids from the floor in a conventional manner. When the user desires to remove the absorbed liquid from the cleaning element 28, the user positions the cleaning element over a receptacle, such as a bucket to catch the liquid. The user pushes the trigger member 76 inward, which releases the locking pin 84 from the slot 86. The mop head base 20 is free to slide in the direction of arrow "A" as seen in FIGS. 5–7.

Figure 6:
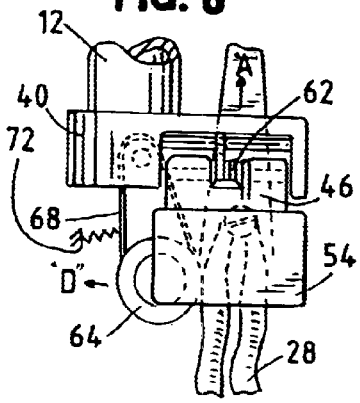
FIG. 6 is a side elevation view with portions removed of the wringing mechanism showing the position of the absorbent cleaning elements at the beginning of the wringing process.
Figure 7:
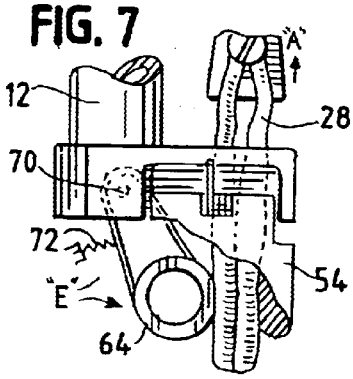
FIG. 7 is a side elevation view with portions removed illustrating the absorbent cleaning elements as they are being drawn through the wringing mechanism.

Initially the extractor roller 64 pivots in the direction of arrow "D", away from the cleaning element 28, as seen in FIG. 6. This is due to the greater initial thickness of the cleaning element 28 adjacent to the u-shaped retaining bar 30. The spring 72 continues to apply a compressive force against the links 66, 68 forcing the extractor roller 64 against the cleaning element 28. The cleaning element 28 is thus compressed between the extractor roller 64 and the compression bars 54, 56. The user continues to draw the mop head base 20 upward in the direction of arrow "A" as seen in FIG. 7. The spring 72 continues pushing against the extractor roller 64 which moves in the direction of arrow "E" once the initial greater thickness of the cleaning element 28 has passed the extractor roller 64. The user continues moving the mop head base 20 upward in the direction of arrow "A" until the entire cleaning element 28 is drawn past the extractor roller 64 and compression bars 54, 56. The result is that the liquid is extracted from the entire length of the cleaning element 28. Stop means are provided on the elongated handle to limit the length of upward travel of the mop head base.

Figure 9:
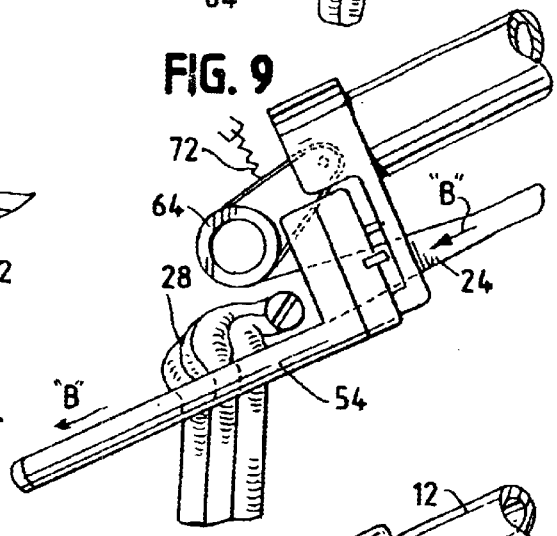
FIG. 9 is a side elevation view with portions removed of the mop head beginning its return to its initial cleaning position by being pushed back through the wringing mechanism.
Figure 8:
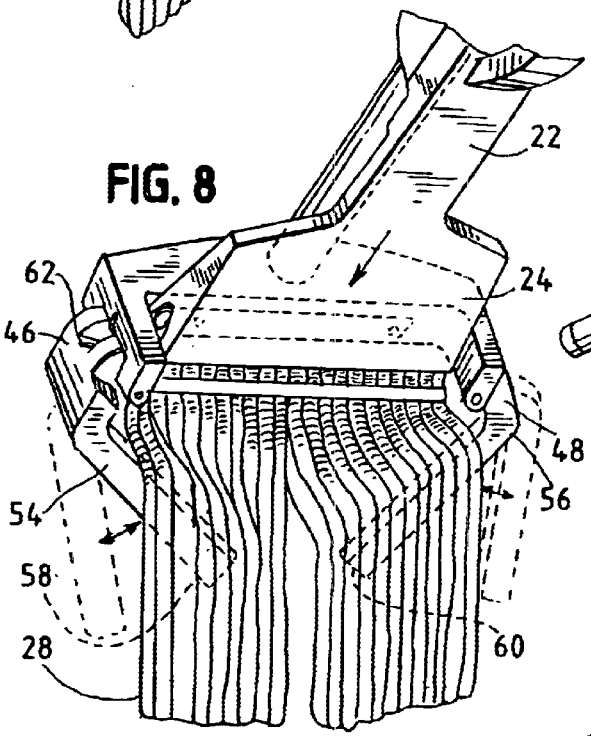
FIG. 8 is a perspective view, partially broken away, of the mop head and absorbent cleaning elements pushed back through the wringing mechanism to reposition the mop head to its initial cleaning position.

At this point the cleaning element 28 is disposed above the wringing mechanism 16. The cleaning element 28 is in a position that makes it unusable for further mopping unless it is repositioned to its initial cleaning position. To accomplish this, the user maintains the mop in the same orientation with the compression bars 54, 56 oriented underneath the stationary frame 40. The user pushes the handle 18 and mop head base 20 downward toward the floor in the direction of arrow "B" as seen in FIGS. 8 and 9. The mop head 24, and more specifically the cleaning element 28 engages the compression bars 54, 56. The force applied in the direction of arrow "B" pushes the cleaning element 28 against the compression bars 54, 56. The force "B" overcomes the force of the spring 62 causing the pivotal gates 46, 48 to rotate about pivot pins 50, 52 into an open position. This is shown in phantom in FIG. 8 and in the completely open position if FIG. 9. It is also seen that the axes of the pivot pins 50, 52 are substantially perpendicular to the longitudinal axis of the extractor roller 64. Although in the preferred embodiment it is preferred that the pivot pins 50, 52 are perpendicular to the longitudinal axis of the extractor roller 64, it is not critical. Any angle that allows the pivotal gates 48, 48 to open when the cleaning element 28 engages the compression bars 54, 56 is an acceptable operational angle. This pivoting of the pivotal gates 54, 56 moves them to a position so that they are no longer parallel to the extractor roller 64. In fact the pivoting causes the gap previously formed between the extractor roller 64 and the compression bars 54, 56 to disappear.

Figure 10:
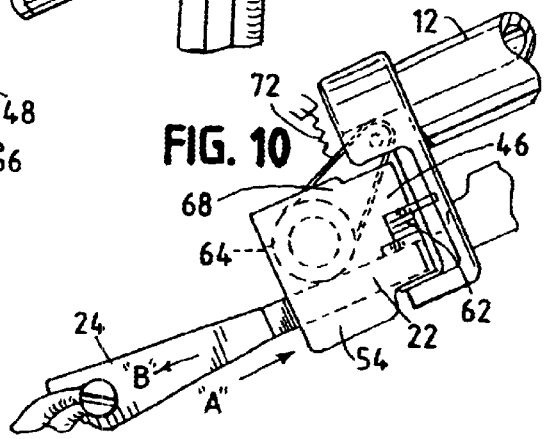
FIG. 10 is a side elevation view with portions removed similar to FIG. 9 with the mop head in its initial cleaning position.

Once the cleaning element 28 passes the end tip 58, 60 of the compression bars 54, 56, the spring 62 applies a force to the pivot gates 46, 48 causing them to close and return to their original cleaning position. This is illustrated in FIG. 10. The extruder roller 64 rests against the neck 22, the compression bars 54, 56 assume their original position parallel to the extruder roller 64, and the mop head 24 is oriented below the wringing mechanism 16. The trigger mechanism 76 locks the handle 18 and mop head base 20 in place so that the mop head 24 doesn't move with respect to the wringer mechanism 16 during mopping.

Figure 11:
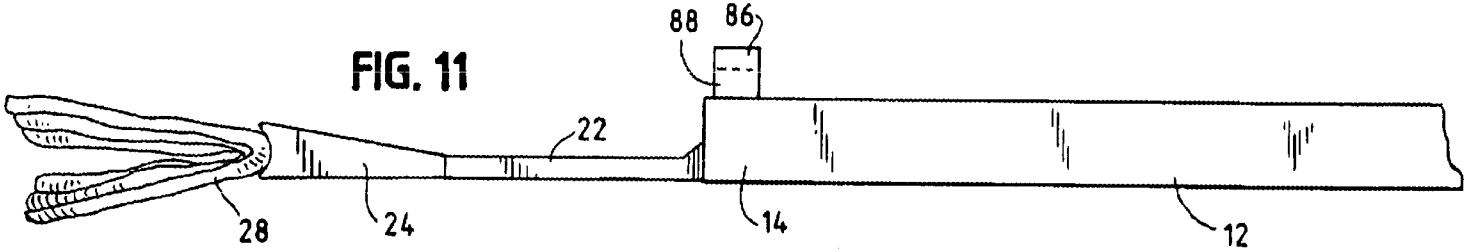
FIGS. 11 through 13 illustrate an alternate embodiment in which the mop head is attached to the elongated handle and the wringer mechanism is mounted on a slidable wringer handle.
Figure 12:
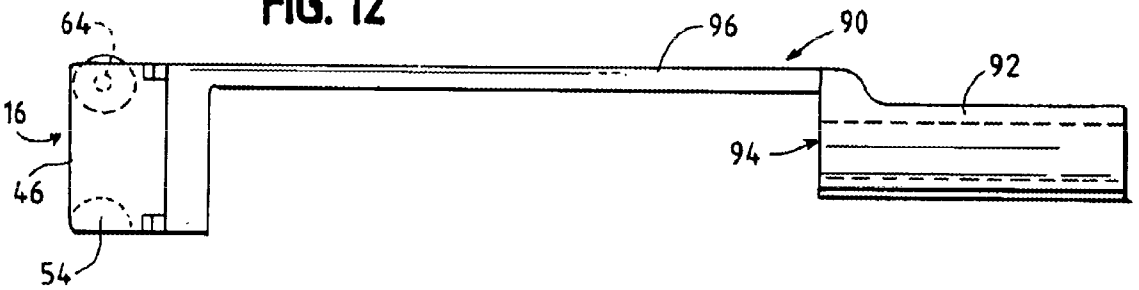
Figure 13:
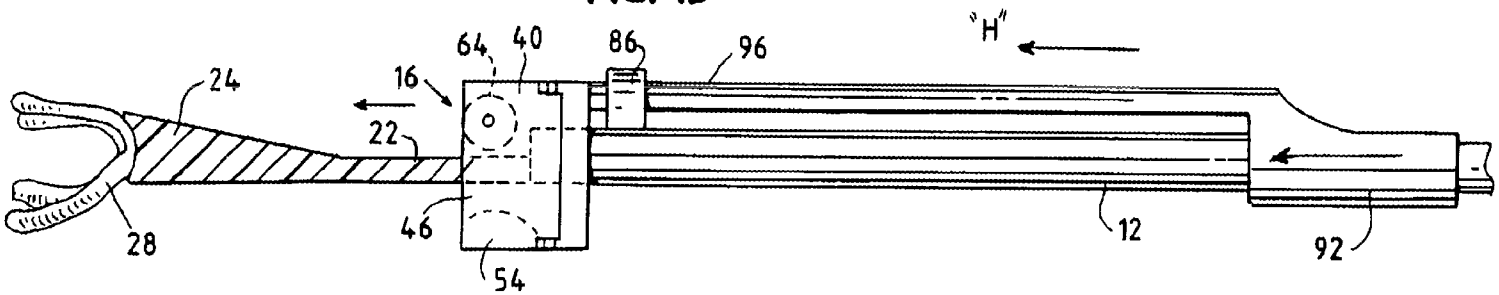

An alternate embodiment is illustrated in FIGS. 11–13. Wherever possible the same reference numbers are used for both the first preferred embodiment and the alternate embodiment. In the alternate embodiment the mop head 24 is attached to the bottom portion 14 of the elongated handle 12. A guide 86 is also attached to the bottom portion 14. The guide 86 has a passageway 88 extending through it. There is a slidable handle/wringer assembly 90 as shown in FIG. 12. There is a handle 92 having a bore 94 passing longitudinally through it. A connecting rod 96 connects the handle 92 to the wringer mechanism 16. The wringer mechanism is identical to the wringer mechanism in the first embodiment with the exception that it is now connected to the slidable handle 92 and moves as opposed to the first embodiment in which the wringer mechanism was attached to the end of the handle 12 and remained stationary.

As seen in FIG. 13, the elongated handle 12 is received in the bore 94 of the slidable handle 92. The connecting rod 96 is received and retained within the guide 86. The wringer mechanism 16 receives the neck 22 of the mop head 24 between the extractor roller 64 and the compression bar 54.

In order to wring out the flexible cleaning element 28, the slidable handle 92 is pushed in the direction of arrow "H". This pushes the entire wringer mechanism toward the flexible cleaning element 28. The cleaning element 28 is drawn between the extractor roller 64 and the compression bar 54 just as in the first embodiment. After the cleaning element is wrung, the slidable handle is drawn back in the direction opposite the arrow "H". The pivotal gates 46, 48 open, allowing the mop head 24 to pass back to its original cleaning position. The operation is substantially identical to the preferred embodiment with the exception of the reversal of the mounting of the mop head 24 and the wringer mechanism 16. The relative movement of the two pieces is the same. A locking device can also be provided on the slidable handle 92 similar to the locking mechanism previously described.

In the mopping position, the wringing mechanism 16 is positioned high enough above the mop head 24 so that it doesn't strike the floor or surface that is being mopped. The mop head and wringer mechanism can be manufactured from plastic parts so that they are moisture resistant.

Thus there has been provided a self-wringing string mop that fully satisfies the objects set forth above. While the invention has been described in conjunction with a specific embodiment, it is evident that many alternatives, modifications and variations will be apparent to those skilled in the art in light of the foregoing description. Accordingly, it is intended to embrace all such alternatives, modifications and variations as fall within the spirit and scope of the appended claims.

What is claimed is:

1. A hand held cleaning device for cleaning a surface comprising:

an elongated handle having a longitudinal axis and opposite top and bottom ends, a stationary frame connected to the bottom end of the elongated handle, the stationary frame having first and second opposite ends;

an extractor roller mounted to the stationary frame, the extractor roller having a longitudinal axis;

a compression member having a first end pivotally connected by means of a pivot connection to the first end of the stationary frame, the pivot connection having an axis substantially perpendicular to the longitudinal axis of the extractor roller, and the compression member mounted in spaced parallel relationship to the extractor roller;

a gap defined between the compression member and the extractor roller;

a mop head slidably mounted on the bottom end of the handle for limited axial movement with respect to the elongated handle, the mop head positioned below the extractor roller in a first cleaning position and adapted for movement in the gap;

a flexible absorbent cleaning element mounted to the mop head;

actuating means connected to the mop head for moving the mop head through the gap thereby drawing the flexible absorbent material between the extractor roller and the compression member for extracting moisture from the absorbent material; and means for pivoting the compression member about the pivot connection away from the extractor roller thereby eliminating the gap for allowing the flexible absorbent material to reposition below the extractor roller in its first cleaning position.

2. The hand held cleaning device of claim 1 and further comprising means for pushing the extractor roller toward the compression member.

3. The hand held cleaning device of claim 2 wherein the means for pushing the extractor roller toward the compression member comprises a spring operatively connected to the extractor roller for applying a force to the extractor roller in a direction toward the compression member.

4. The hand held cleaning device of claim 1 and further comprising a second compression member having a first end pivotally connected by means of a second pivot connection to the second opposite end of the frame.

5. The hand held cleaning device of claim 4 wherein the first and second compression members both have a second end opposite the first end, the second ends positioned adjacent to each other when the mop is in the first cleaning position.

6. The hand held cleaning device of claim 1 wherein the means for pivoting the compression member about the pivot connection away from the extractor roller is the flexible cleaning element attached to the mop head.

7. The hand held cleaning device of claim 6 and further comprising spring means connected to the compression member for pivoting the compression member to its position in spaced parallel relationship to the extractor roller after the compression member has been pivoted away from the extractor roller.

8. The hand held cleaning device of claim 1 and further comprising locking means on the mop head for releasably securing the mop head to the elongated handle.

9. The hand held cleaning device of claim 8 wherein the locking means comprises a handle with a releasable latch engaging the elongated handle.

10. A hand held cleaning device for cleaning a surface comprising:

an elongated handle having a longitudinal axis and opposite top and bottom ends, a mop head connected to the bottom end of the elongated handle, a flexible absorbent cleaning element mounted to the mop head;

a slidable frame having top and bottom opposite ends and first and second opposite sides, the top end slidably mounted on the bottom end of the handle for limited axial movement with respect to the elongated handle;

an extractor roller mounted to the first side and the bottom end of the slidable frame, the extractor roller having a longitudinal axis;

a compression member having a first end pivotally connected by means of a pivot connection to the slidable frame, the pivot connection having an axis substantially perpendicular to the longitudinal axis of the extractor roller, the compression member mounted in spaced parallel relationship to the extractor roller;

a gap defined between the compression member and the extractor roller;

the mop head positioned below the extractor roller in a first cleaning position and adapted for movement in the gap;

the slidable frame adapted for moving over the mop head thereby drawing the mop head and the flexible absorbent material between the extractor roller and the compression member for extracting moisture from the absorbent material; and means for pivoting the compression member about the pivot connection away from the extractor roller thereby eliminating the gap for allowing the flexible absorbent material to reposition below the extractor roller in its first cleaning position.

11. The hand held cleaning device of claim 10 and further comprising means for pushing the extractor roller toward the compression member.

12. The hand held cleaning device of claim 11 wherein the means for pushing the extractor roller toward the compression member comprises a spring operatively connected to the extractor roller for applying a force to the extractor roller in a direction toward the compression member.

13. The hand held cleaning device of claim 10 and further comprising a second compression member having a first end pivotally connected by means of a second pivot connection to the second side and bottom of the slidable frame.

14. The hand held cleaning device of claim 13 wherein the first and second compression members both have a second end opposite the first end, the second ends positioned adjacent to each other when the mop is in the first cleaning position.

15. The hand held cleaning device of claim 10 wherein the means for pivoting the compression member about the pivot connection away from the extractor roller is the flexible cleaning element attached to the mop head.

16. The hand held cleaning device of claim 15 and further comprising spring means connected to the compression member for pivoting the compression member to its position in spaced parallel relationship to the extractor roller after the compression member has been pivoted away from the extractor roller.

17. The hand held cleaning device of claim 10 and further comprising locking means on the slidable frame for releasably securing the slidable frame to the elongated handle.

18. The hand held cleaning device of claim 17 wherein the locking means comprises a handle with a releasable latch engaging the elongated handle.

19. A hand held cleaning device for cleaning a surface comprising:

an elongated handle having a longitudinal axis and opposite top and bottom ends, a stationary frame connected to the bottom end of the elongated handle, the stationary frame having first and second opposite ends;

an extractor roller mounted to the stationary frame, the extractor roller having a longitudinal axis;

a first compression member having a first end pivotally connected by means of a pivot connection to the first end of the stationary frame, a second compression member having a first end pivotally connected by means of a pivot connection to the second end of the stationary frame, the first and second compression members mounted in axial alignment with respect to each other and in spaced parallel relationship to the extractor roller, the first and second compression members having respective second ends opposite their respective first ends, with the second ends adjacent to each other when the hand held cleaning device is in an initial cleaning position, a gap defined between the compression members and the extractor roller;

a mop head slidably mounted on the bottom end of the handle for limited axial movement with respect to the elongated handle, the mop head positioned below the extractor roller in the first cleaning position and adapted for movement in the gap;

a flexible absorbent cleaning element mounted to the mop head;

actuating means connected to the mop head for moving the mop head through the gap thereby drawing the flexible absorbent material between the extractor roller and the compression member for extracting moisture from the absorbent material; and means for pivoting the compression members about their respective pivot connections for moving the opposite ends away from each other thereby eliminating the gap for allowing the flexible absorbent material to pass between the pivoted compression members to reposition the flexible absorbent material below the extractor roller to its first cleaning position after it is wrung out.

20. The hand held cleaning device of claim 19 and further comprising means for pushing the extractor roller toward the compression members.

21. The hand held cleaning device of claim 19 wherein the means for pushing the extractor roller toward the compression members comprises a spring operatively connected to the extractor roller for applying a force to the extractor roller in a direction toward the compression members.

22. The hand held cleaning device of claim 19 wherein the means for pivoting the compression members about their pivot connections away from each other is the flexible cleaning element attached to the mop head.

23. The hand held cleaning device of claim 19 and further comprising spring means connected to each of the compression members for pivoting the compression members to their position in axial alignment with each other after the compression members have been pivoted away from each other.

24. The hand held cleaning device of claim 19 and further comprising locking means on the mop head for releasably securing the mop head to the elongated handle.

25. The hand held cleaning device of claim 24 wherein the locking means comprises a handle with a releasable latch engaging the elongated handle.

26. A hand held cleaning device for cleaning a surface comprising:

an elongated handle having a longitudinal axis and opposite top and bottom ends, a stationary frame connected to the bottom end of the elongated handle, the stationary frame having first and second opposite ends;

an extractor roller mounted to the stationary frame, the extractor roller having a longitudinal axis;

a compression member having a first end pivotally connected by means of a hinge connection to the first end of the stationary frame, the compression member and extractor roller mounted in spaced parallel relationship to each other on the stationary frame;

a gap defined between the compression member and the extractor roller;

a mop head slidably mounted on the bottom end of the handle for limited axial movement with respect to the elongated handle, the mop head positioned below the extractor roller in a first cleaning position and adapted for movement in the gap;

a flexible absorbent cleaning element mounted to the mop head;

actuating means connected to the mop head for moving the mop head through the gap thereby drawing the flexible absorbent material between the extractor roller and the compression member for extracting moisture from the absorbent material; and means for pivoting the compression member about the hinge connection away from the extractor roller and out of the parallel relationship with the extractor roller for eliminating the gap to allow the flexible absorbent material to reposition below the extractor roller in its first cleaning position.

27. The hand held cleaning device of claim 26 and further comprising means for pushing the extractor roller toward the compression member.

28. The hand held cleaning device of claim 27 wherein the means for pushing the extractor roller toward the compression member comprises a spring operatively connected to the extractor roller for applying a force to the extractor roller in a direction toward the compression member.

29. The hand held cleaning device of claim 26 and further comprising a second compression member having a first end pivotally connected by means of a second hinge connection to the second opposite end of the frame.

30. The hand held cleaning device of claim 29 wherein the first and second compression members both have a second end opposite the first end, the second ends positioned adjacent to each other when the mop is in the first cleaning position.

31. The hand held cleaning device of claim 26 wherein the means for pivoting the compression member about the hinge connection away from the extractor roller is the flexible cleaning element attached to the mop head.

32. The hand held cleaning device of claim 31 and further comprising spring means connected to the compression member for pivoting the compression member to its position in spaced parallel relationship to the extractor roller after the compression member has been pivoted away from the extractor roller.

33. The hand held cleaning device of claim 26 and further comprising locking means on the mop head for releasably securing the mop head to the elongated handle.

34. The hand held cleaning device of claim 33 wherein the locking means comprises a handle with a releasable latch engaging the elongated handle.

35. A wringing mechanism for use on a mop having an elongated handle with top and bottom ends and a plurality of absorbent material mopping elements at the bottom end comprising:

a stationary frame disposed at the bottom end of the elongated handle, the stationary frame having first and second opposite ends;

an extractor roller mounted to the stationary frame, the extractor roller having a longitudinal axis;

a compression member having a first end pivotally connected by means of a hinge connection to the first end of the stationary frame, the compression member and extractor roller mounted on the stationary frame in spaced parallel relationship to each other;

a gap defined between the compression member and the extractor roller;

a mop head disposed at the bottom end of the handle for limited movement with respect to the compression member and the extractor roller, the mop head positioned below the extractor roller in a first cleaning position and adapted for movement in the gap;

actuating means for moving the mop head through the gap thereby drawing the flexible absorbent material between the extractor roller and the compression member for extracting moisture from the absorbent material; and means for pivoting the compression member about the hinge connection away from the extractor roller and out of the parallel relationship with the extractor roller for eliminating the gap to allow the flexible absorbent material to reposition below the extractor roller in its first cleaning position.

36. A wringing mechanism for use on a mop having an elongated handle with top and bottom ends and a plurality of absorbent material mopping elements at the bottom end comprising:

a moveable frame disposed at the bottom end of the elongated handle, the moveable frame having first and second opposite ends;

an extractor roller mounted to the moveable frame, the extractor roller having a longitudinal axis;

a compression member having a first end pivotally connected by means of a hinge connection to the first end of the moveable frame, the compression member and extractor roller mounted on the moveable frame in spaced parallel relationship to each other;

a gap defined between the compression member and the extractor roller;

a mop head disposed at the bottom end of the handle for movement with respect to the compression member and the extractor roller, the mop head positioned below the extractor roller in a first cleaning position and adapted for movement in the gap;

actuating means for moving the mop head through the gap thereby drawing the flexible absorbent material between the extractor roller and the compression member for extracting moisture from the absorbent material; and means for pivoting the compression member about the hinge connection away from the extractor roller and out of the parallel relationship with the extractor roller for eliminating the gap to allow the flexible absorbent material to reposition below the extractor roller in its first cleaning position.

* * * * *